US005131249A

United States Patent [19]

Baden et al.

[11] Patent Number: 5,131,249

[45] Date of Patent: Jul. 21, 1992

[54] KEY FOR A CYLINDER LOCK, ESPECIALLY FOR LOCKING SYSTEMS

[75] Inventors: Hans-Dieter Baden, Velbert; Manfred Hinz, Heiligenhaus, both of Fed. Rep. of Germany

[73] Assignee: BKS GmbH, Velbert, Fed. Rep. of Germany

[21] Appl. No.: 631,012

[22] Filed: Dec. 19, 1990

[30] Foreign Application Priority Data

Jan. 5, 1990 [DE] Fed. Rep. of Germany ..... 4000179

[51] Int. Cl.[5] ..... E05B 19/08

[52] U.S. Cl. ..... 70/398; 70/403; 70/407; 70/409

[58] Field of Search ..... 70/420, 492–495, 70/409, 398, 395, 402–407, 358, DIG. 37

[56] References Cited

U.S. PATENT DOCUMENTS

| | | | |
|---|---|---|---|
| 1,074,418 | 9/1913 | Doughty | 70/407 |
| 2,620,649 | 12/1952 | Bernardo | 70/358 |
| 4,667,495 | 5/1987 | Girard et al. | 70/409 X |
| 4,787,225 | 11/1988 | Häuser et al. | 70/402 X |

FOREIGN PATENT DOCUMENTS

| | | | |
|---|---|---|---|
| 0267316 | 5/1988 | European Pat. Off. . | |
| 817409 | 10/1951 | Fed. Rep. of Germany | 70/358 |
| 2037071 | 2/1972 | Fed. Rep. of Germany | 70/402 |
| 2344473 | 5/1975 | Fed. Rep. of Germany | 70/493 |
| 2551523 | 5/1977 | Fed. Rep. of Germany . | |
| 2931653 | 2/1981 | Fed. Rep. of Germany | 70/493 |
| 3410462 | 9/1985 | Fed. Rep. of Germany . | |
| 3817494 | 11/1989 | Fed. Rep. of Germany | 70/493 |
| 2492872 | 4/1982 | France | 70/409 |
| 2551794 | 3/1985 | France | 70/493 |
| 144705 | 1/1921 | United Kingdom | 70/407 |
| 2184155 | 6/1987 | United Kingdom | 70/403 |

*Primary Examiner*—Lloyd A. Gall
*Attorney, Agent, or Firm*—Herbert Dubno

[57] ABSTRACT

A key for a cylinder lock has a relatively slender profile region and a bitting region of greater thickness and a generally cylindrical configuration with or without longitudinally-extending flats. The bitting recesses can be provided round this bitting region and axially therealong and the profile region can be formed with grooves milled in its parallel flanks to increase key variability.

16 Claims, 5 Drawing Sheets

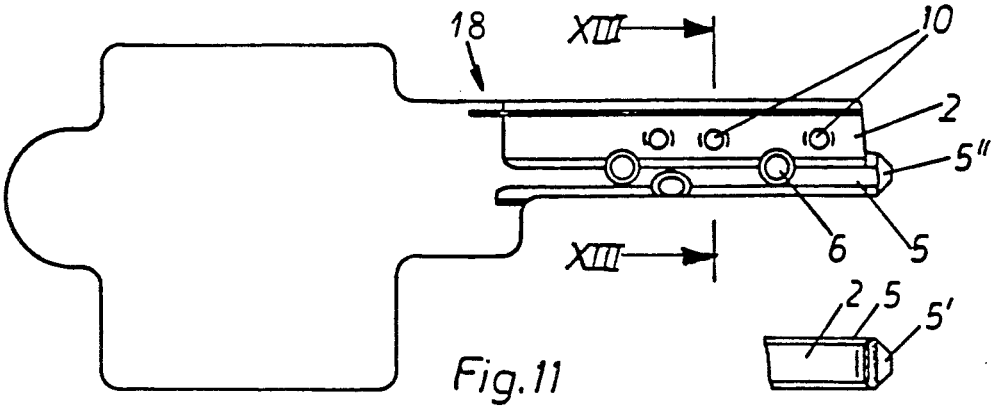
Fig.11
Fig.12
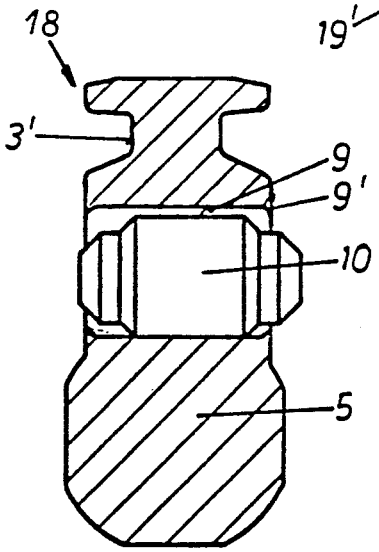
Fig.13
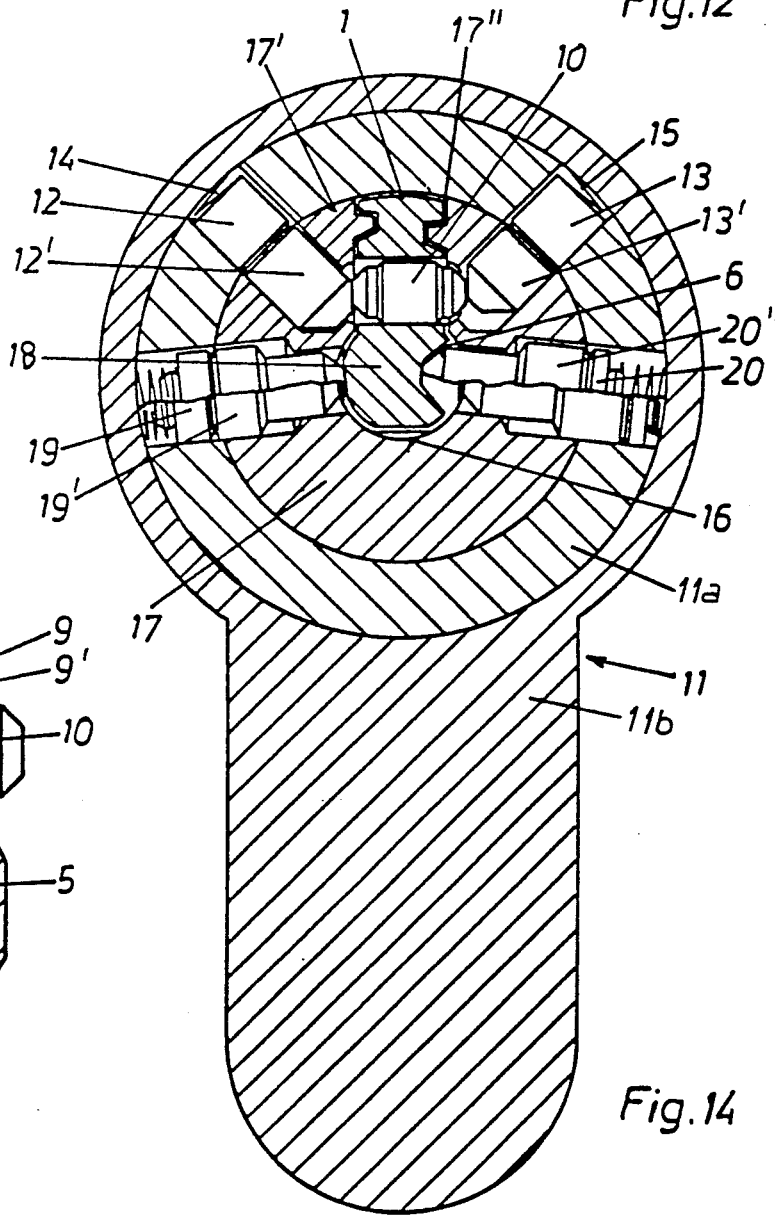
Fig.14

KEY FOR A CYLINDER LOCK, ESPECIALLY FOR LOCKING SYSTEMS

BACKGROUND OF THE INVENTION

Our present invention relates to a key for a cylinder lock, especially for locking systems and, more particularly, for a cylinder lock of the type in which a cylinder core has a key channel which opens at a cylindrical periphery of the core so that the back of the blade of the key can lie substantially flush with its cylindrical periphery and wherein the key has a profile region which can be formed with longitudinal grooves and recesses formed by drilling, milling or other cutting operations and can form bits in the blade cooperating with tumbler pins of the cylinder lock. The term "locking systems" is used to describe systems of locks in homes, large administration buildings and wherever a multiplicity of locks may be required with selective access, exclusive access submaster-key access, grandmaster-key access, etc.

BACKGROUND OF THE INVENTION

Keys for cylinder locks of this type are generally formed as flat keys in a variety of configurations. Mention may be made of DE-OS 34 10 462, DE-OS 38 17 494, DE-PS 25 33 494, DE-AS 10 30 727 and DE-PS 25 51 523 as examples of such keys in which the longitudinal profiling grooves are formed in a profile region which has substantially the same thickness or width as the key back and the breast of the key.

The key blade can be formed with notches constituting the bitting in one or two rows of regions which are of substantially the same width as the profile region or may even be smaller in width.

This is also the case for the key of German patent DE-PS 37 11 935 which has a region of substantially circular cylindrical configuration and which is interrupted by longitudinal grooves which can be notched to provide the bitting of the key. This notched or bitting region is likewise a relatively slender region.

German patent document DE-PS 680 416 describes keys for cylindrical-type locks which have a cruciform or star-shaped profile which requires the core to have corresponding radial longitudinal ribs in which the bitting can be provided. Longitudinal profile grooves to vary the profile of the key and therefore the profile of the channel into which the key can be inserted are not provided in this system.

In European patent document EU-A1 0 267 316, a key configuration is described in which the key shaft has a polygonal cross section with mutually parallel longitudinal edges in which recesses can be formed for the actuation of the lock cylinder tumbler pins. German patent DE PS 817 409 and Austrian patent document AU-B-485 117 describe keys for cylinder locks which have a circularly cylindrical shaft with bitting and which can be provided with one or two diametrically opposite longitudinal ribs which slide in grooves formed in the inner wall of the bore of the cylinder core to provide the necessary rotational coupling between the key and the core. These longitudinal ribs are very flat radially so that they are incapable of receiving longitudinal grooves for profile variations.

Thus, while it can be seen that there are many key configurations, those with flat blades are prone to distortion and bending in use and those with massive constructions are limited in variability and versatility because of the lack of longitudinal groove profiling. Other keys have these disadvantages or lack versatility with respect to the bitting which can be provided.

OBJECTS OF THE INVENTION

It is, therefore, the principal object of the present invention to provide a key for a cylinder lock which has improved structural stability and strength, can have a wide variety of profiles and which is highly versatile with respect to bitting which can be provided.

Another object of the invention is to provide an improved key which eliminates drawbacks of earlier keys including those described above.

SUMMARY OF THE INVENTION

These objects and others which will become apparent hereinafter are attained, in accordance with the invention, in a key of the type described above in which the recessed or bitting region of the key has a substantially round cylindrical configuration and is wider than the profile region of the key which is formed with longitudinal grooves in a variety of profiles.

In this manner, a comparatively wide and generally cylindrical bitting region can be formed with a greater number of recesses, cutouts or bits for cooperation with respective cylinder tumbler elements than earlier keys since these recesses can be distributed over the correspondingly larger periphery of the bitting region as well as over the entire length thereof.

Nevertheless, the profile region can be grooved to any desired profile while retaining a relatively narrow or thin configuration and the key will nevertheless have a high stability and strength because of the comparatively large width or thickness of the bitting region.

The generally round profile of the comparatively thick or wide bitting region has been found, in addition, to improve the radial guidance of the key in the channel of the cylinder core and to enable the key to deliver a substantial locking or unlocking force. The improved radial guidance allows guide grooves which have hitherto been found to be necessary in the region of the back of the blade in many keys to be avoided. This region can, therefore, also be involved in profile variation which increases the versatility of the key of the invention. A comparatively wide or high profile region allows a comparatively large number of grooves to be formed therein of varying sizes and shapes to ensure a wide variety of keys and associated locks for a key blade width or height.

Advantageously, the profiling grooves are formed in lateral flanks of the profile region which are parallel to one another while the bitting region projects on both sides beyond these flanks. The bitting region can have, therefore, a circular cross section or a generally rounded cross section which can be provided with flats on both lateral sides and on the bottom.

Since the cylindrical surface can extend 270° or more, a comparatively large number of angularly-based recesses can be formed there in addition to the recesses which are spaced axially along the bitting region. While longitudinal rows of recesses can be provided, other bitting patterns may be used.

For example, the recesses may be provided in a generally helical pattern. Individual recesses can merge with one another, i.e. intersect, and a number of recesses can be provided at the same axial location along the blade. According to a further feature of the invention, the key in its profile region can have transverse passages, holes or bores in which respective test pins can be limitedly shiftable, these test pins having beveled or frustoconical ends and being retained in the key but capable of projecting therefrom to cooperate with tumbler pins of the cylinder. The length of each test pin is greater than the thickness of the profile region so that the test pin will project therefrom.

The advantage of this construction is that the security of the lock can be increased since the tumbler pins which cooperate with the test pins need not project into the key channel of the core and thus need not be visible from the exterior.

According to another feature of the invention, the thick bitting region projects beyond the profile region at the front end of the key to form a frustoconical projection which can simplify insertion of the key into the key channel of the core. For this purpose, the key channel may have a frustoconical enlargement guiding the key into the channel and effecting a precentering thereof.

The key for a cylinder lock having a cylinder lock rotatable in a cylinder body, especially for locking systems as described, thus can comprise:

a handle;

an abutment formed on the handle; and an elongated blade extending from the abutment, the blade being formed with:

a back conforming substantially to the periphery, a profile region formed with the back and having opposite flanks adapted to be formed with longitudinal grooves establishing a profiling of the profile region and controlling insertion of the blade in the core, and a bitting region having a bar configuration adjacent the profile region and extending longitudinally over the full length of the blade, the bitting region accommodating a plurality of rows of recesses engageable by the tumbler pins, the bitting region being wider than the profile region and being rounded generally cylindrically, the bitting region extending to the abutment.

BRIEF DESCRIPTION OF THE DRAWING

The above and other objects, features and advantages of the present invention will become more readily apparent from the following description, reference being made to the accompanying drawing in which:

FIG. 11 is a side elevational view of still another key according to the invention in which the blade is provided with transversely shiftable test pins for use in the cylinder lock of FIG. 14;

FIG. 12 is a partial plan view of the tip of the latter key;

FIG. 13 is a cross sectional view taken along the line XIII—XIII of FIG. 11;

FIG. 14 is a cross sectional view through a cylinder lock having the key of FIG. 11 inserted therein;

SPECIFIC DESCRIPTION

Figure 1:
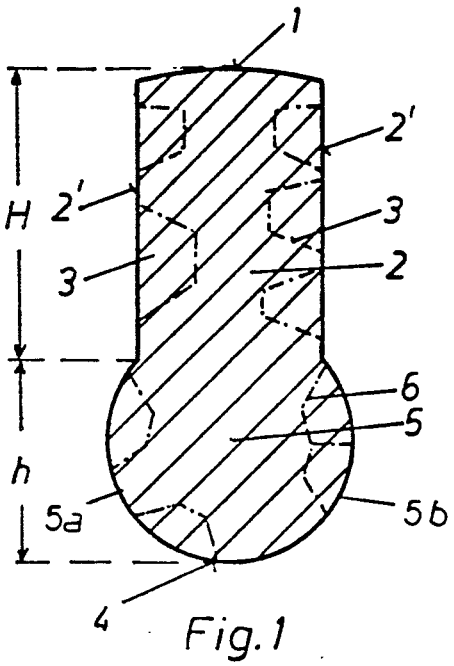
FIG. 1 and 2 are cross sectional views through blades of two key blanks according to the invention showing bitting and groove portions which can be formed therein in dot-dash lines.

FIG. 1 shows a cross section through the blade of a cylinder key, according to the invention, which can be used in the locks of FIGS. 14–16 which will be described in greater detail below, these cylinder locks being preferably employed for locking systems as described above.

Figure 3:
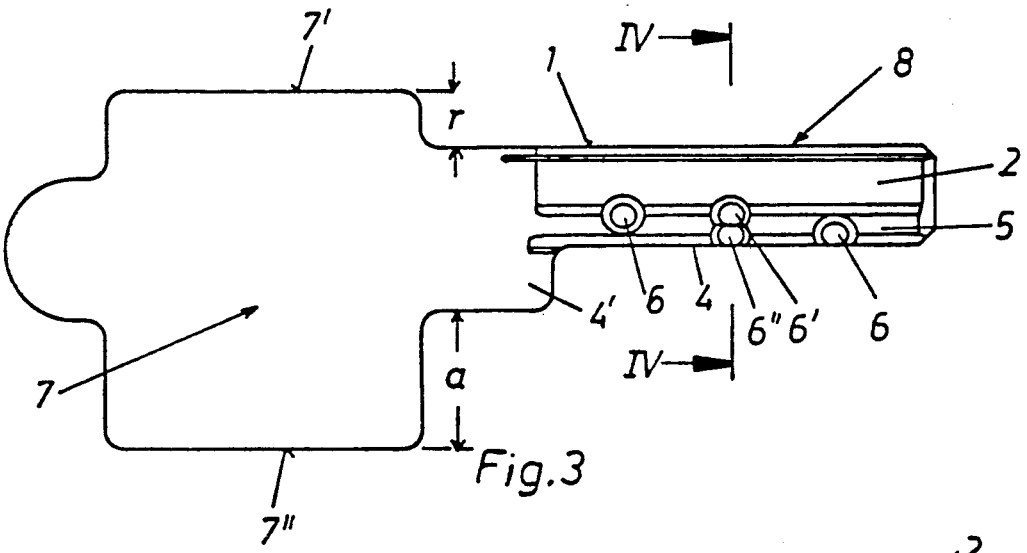
FIG. 3 is an elevational view of a cylinder key according to the invention with bitting in the form of cutouts lying in two different longitudinal rows and having an overlapping relationship.

The blank comprises a key blade, shown in section in FIG. 1, and a handle 7 as best seen in FIG. 3 which may be a generally rectangular tab formed unitarily, i.e. in one piece, with the blade 8, and from which the blade 8 extends at one side of the handle 7.

The blade is formed with a key back 1 which, as illustrated in FIG. 1, has an arcuate shape and a radius of curvature corresponding to the radius of the cylinder core in which the key is to be inserted, as will be apparent from FIG. 14, for example.

Figure 2:
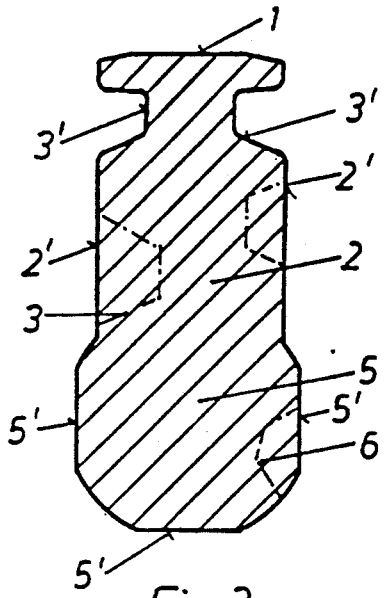

Adjacent this key back 1 the blade 8 has a profile portion 2 which has, in the blank, parallel planar flanks 2' into which longitudinal grooves 3, shown only by dot-dash lines, can be milled. The core must, of course, have ribs corresponding to the milled grooves to permit the blade to be inserted into the core. In subsequent Figures, the grooves 3 may not be illustrated for the sake of simplicity but it will be understood that at least the grooves shown at 3' in FIG. 2 are always present and that the additional grooves 3 are optional but are generally milled in the profile portion 2.

The profile portion 2 of the key is connected to a bitting region 5 which can be cut to form recesses such as are illustrated in dot-dash lines at 6, e.g. by a drill. The bitting region 5 has a greater width than the profile region 2 and may be referred to herein as the bar-shaped portion or bead of the key blade.

The key front 4 is formed by the bitting region 5. The recesses 6 may also be formed by milling or by any other machining operation and are designed to receive the tumbler pins of the cylinder lock.

As can be seen in the embodiment of FIG. 1, the bar portion 5 of the blade has cylindrically curved surfaces **5*a* and 5*b* which project outwardly beyond the planks 2' and are connected at the blade front 4 to impart a circularly cylindrical form to the bitting portion 5 of the blade. As a consequence of the greater diameter of this portion of the blade than the thickness of the profile portion 2**, a comparatively large number of recesses or cuts 6, i.e. bits, can be formed in the blade. In spite of the large number of recesses 6 which can be provided, the key has, even in the bitting region 5, high structural stability and is comparatively insensitive to wear.

The height H of the profile region 2 of the blade, measured in the radial direction, exceeds the height h of the bitting region 5. As a consequence, a comparatively large number of longitudinal grooves 3 can be milled into the profile region 2 to provide an especially high degree of variability of the keys and the locks with which they can be used.

The blank shown in FIG. 2 differs from that of FIG. 1 in that the grooves 3' of generally trapezoidal shape can be previously formed in the blank and can have a variety of shapes or sizes or can be universal for all keys of a particular type, although the additional grooves 3 to be milled in the sides 2' can be varied for different locks or purposes.

The bitting or bar-shaped portion 5 in this embodiment, however, is not precisely circularly cylindrical as is the case with the embodiment of FIG. 1 but on both of its lateral sides and on its underside forming the front or breast of the key can have flats 5' extending the full length of the blade. Of course the bitting recesses 6 can be drilled or cut into the bitting region 5 in the same manner as in the embodiment of FIG. 1.

Figure 4:
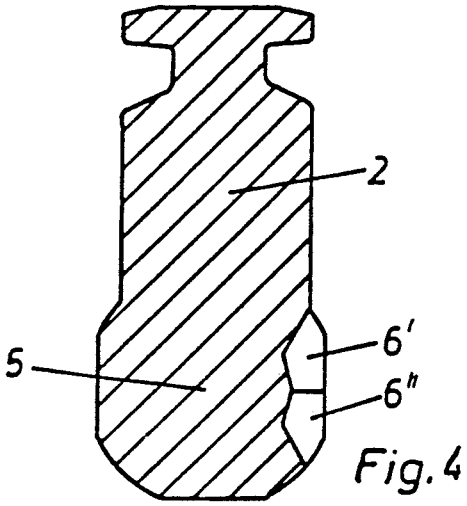
FIG. 4 is a cross sectional view taken along the line IV—IV of FIG. 3, drawn to a larger scale.
Figure 5:
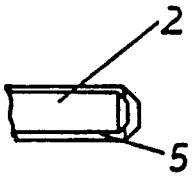
FIG. 5 is a partial plan view of the tip of the key shown in FIG. 3.
Figure 6:
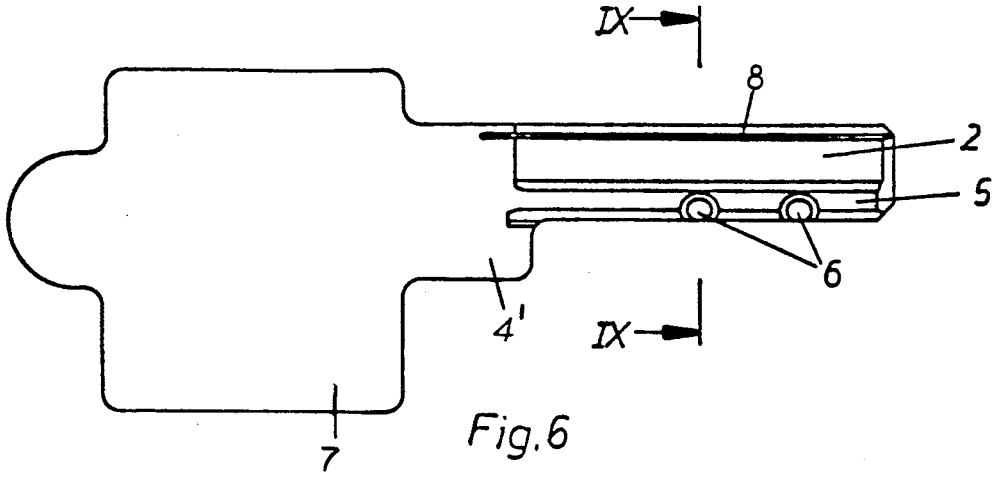
FIGS. 6 and 7 are side elevational views of two differently formed cylinder keys according to the invention.

FIGS. 3-5 illustrate a key made from the blank of FIG. 2 although the principles of this key, are, of course, also applicable to FIG. 1.

From FIGS. 3-5 it can be seen that the key, as a whole, comprises the handle or tab 7 and the blade or shaft 8 which extends therefrom. The blade has the profile region 2 of substantially rectangular cross section and the thick bitting region or bar 5 formed unitarily therewith.

The handle 7 is formed at an off-center location along one side thereof with an abutment 4' engageable with the end face of the cylinder core and thereby limiting penetration of the blade into the lock, the blade 8 extending from this abutment 4' in such manner that the distance r of the back 1 of the blade 8 from the neighboring outer edge 7' of the handle 7 is substantially less than the distance a between the abutment 4' and the corresponding edge 7" of the handle. This offset arrangement corresponds to the usual configuration of cylinder locks which can have the configurations shown in FIGS. 14-16.

In the bitting region 5, two axially adjoining rows of recesses or cutouts (bits) 6, 6', 6" are provided. The recesses 6' and 6" of two different rows but located at the same point along the length of the blade, i.e. in the same axial positions of the blade, can overlap or merge with one another as is clearly visible in FIGS. 3 and 4. The configurations of the recesses are shown in detail in FIG. 4 and the relationship between these recesses and the tumblers or pins of the lock engaging these recesses can be seen from FIG. 14. Because of the overlapping configuration, it will be apparent that a large number of recesses 6 may be provided in the bitting region 5 and, correspondingly, it can be seen that the bitting portions can be extremely diverse.

Furthermore, the cutouts need not have the same depths or configurations and may be provided anywhere around the bar portion 5 of the blade. The keys shown in FIGS. 6-10 are, like the key described in connection with FIGS. 3 and 4, provided with the handle 7 and the blade 8 as described wherein the blade is made up of the profile portion 2 and the bitting portion 5.

As in the embodiment of FIGS. 3 and 4, the bitting portion 5 as in the embodiment of FIGS. 3 and 4, is bar-shaped and generally cylindrical although it is provided with the flats 5' previously described, rounded portions 5" of the circular cylindrical configuration bridging flats 5'. As a comparison of FIGS. 6 and 7 will show, the bitting of the otherwise identical keys can be different both with respect to the angular positions of the recesses 6, which in the case of FIG. 9 can be considered to lie in a four o'clock position, and in the case of FIG. 10 in a two o'clock position.

The addition, these Figures show that the recesses 6 can be spaced anywhere along the respective rows, i.e. can be close to the abutment 4' or further from the abutment 4'.

Figure 9:
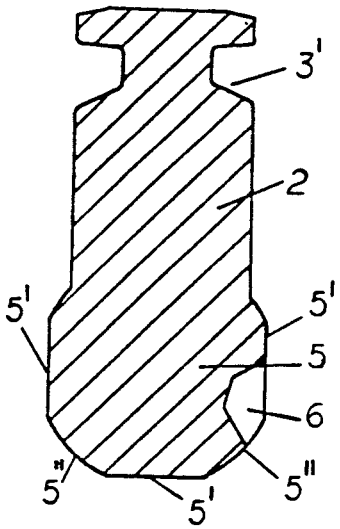
FIGS. 9 and 10 are cross sectional views drawn to a larger scale and taken respectively along the lines IX—IX and X—X of FIGS. 6 and 7.
Figure 10:
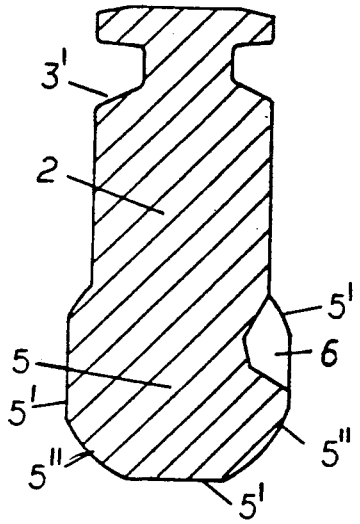
Figure 8:
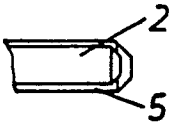
FIG. 8 is a partial plan view of the tips of these keys.
Figure 7:
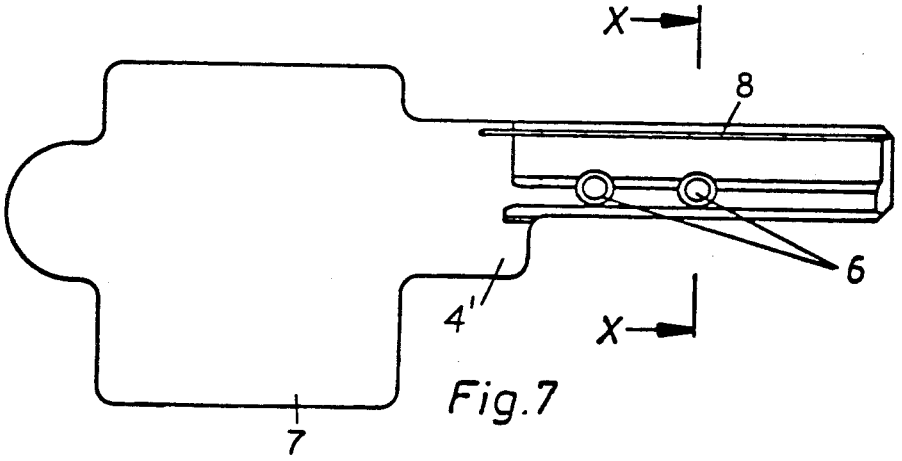

While the profile portions 2 are not shown to be grooved except for the grooves 3', a comparison of FIGS. 9 and 10 will show that these grooves differ from one another so that the keys cannot be inserted into the same cylinder core. Furthermore, various additional grooves may be provided in the profile portion 2 as illustrated, for example, in FIGS. 1 and 2. It is also possible to provide the recesses on the opposite sides of the blade and even on the underside of the bitting region 5, thereby demonstrating the high degree of variability in the case and locks according to the invention.

In FIGS. 11-14, we have shown a key and lock having the principles described with respect to the profile region 2 and the bitting region 5 which projects outwardly beyond both flanks or sides of the profile region 2 and in which the recesses 6 can be provided as bits for the tumbler pins of the cylinder.

The key in this embodiment is additionally provided with transverse throughgoing bores 9 in the profile region accommodating limitedly shiftable test pins 10. To limit the displacement of the test pins 10, the edges 9' of these bores can be turned slightly inwardly as will be apparent from FIG. 13, the test pins being bevelled at both offset ends.

As FIG. 14 illustrates, the test pins 10 are engageable with additional tumbler pin pairs 12, 12' and 13, 13' biased inwardly by springs 14 and 15. More specifically, the cylinder lock 11 of FIG. 14 comprises a core 17 into a channel 17" of which, opening at the periphery 17' of the core, a key 18, for example conforming to the key of FIGS. 11 and 13, can be inserted.

The core 17 is rotatable in a cylinder body 11*a* which, in turn, is received in the housing 11*b* of the lock. In the absence of the appropriate key, the springs 14 and 15 bias the pins 12 and 13 radially inwardly past the periphery 17' of the core and prevent rotation of the lock. Additional tumblers 19, 19' and 20, 20' engage the bitting 6 and have been shown in two positions in FIG. 14. In their innermost positions, the pin portions 19 may extend into the core 17 to prevent rotation.

Should the wrong key be inserted, the pin portion 20' will not engage a bit 6 and thus will penetrate into the body 11*a* to prevent rotation. The tumbler pins 19, 19' and 20, 20' are biased inwardly by springs as well. When the proper key is inserted, of course, the junctions between pins 12 and 12', between pins 13 and 13', between pins 19 and 19' and between pins 20 and 20' all lie at the periphery 17' of the core to permit rotation of the latter.

The spring 14 of the pin pair 12, 12', in the embodiment illustrated, is stronger than the spring 15 of the pin pair 13, 13'. As a consequence, when the proper key is inserted into the lock and the bar portion is received in the correspondingly-shaped part 16 of the channel, the pin 10 engaged by the tumbler pair 12, 12' is shifted to the right to hold the pin 13' flush with the periphery 17' of the core 17 to permit rotation.

In the embodiment of FIGS. 11 and 13, recesses 6 are provided in two rows and are longitudinally offset from one another on one side while the opposite side may not have any recesses.

The bar-shaped portion 5 of the blade projects beyond the bevel portion 2 thereof, see FIGS. 11 and 12, and can have its projecting end, an insertion point 5", which can be bevelled as well.

The projecting portion of the key can cooperate with a frustoconical enlargement of the key channel 16, 17" for quicker and easier insertion of the key into the lock.

Figure 16:
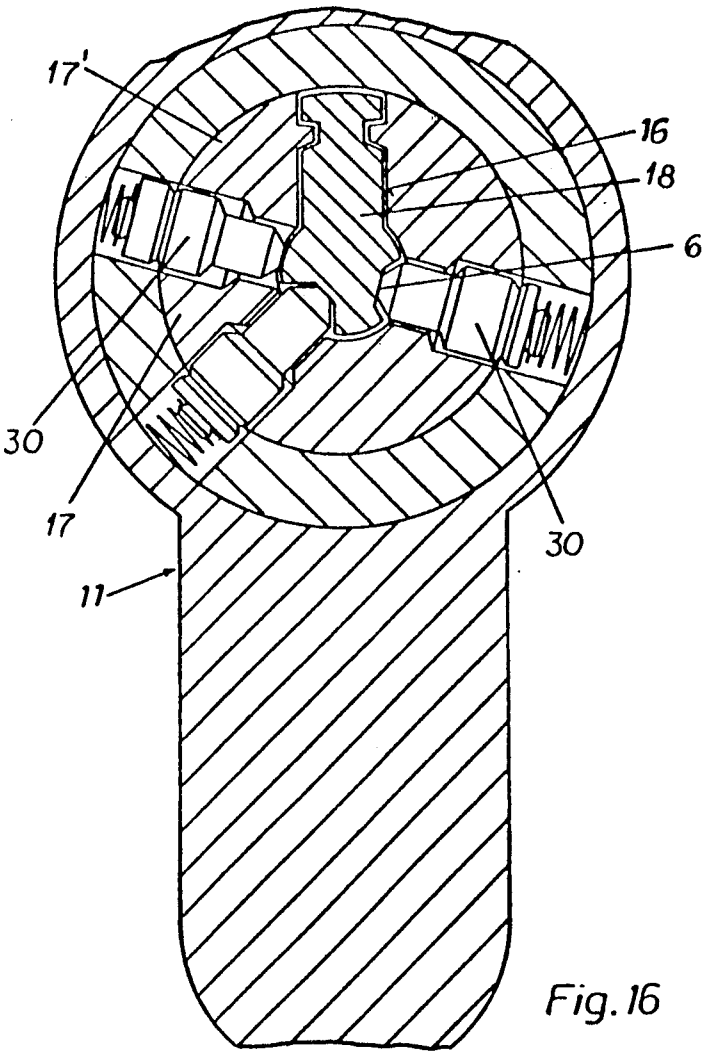
FIG. 16 is a cross sectional view of a lock similar to that of FIG. 15 but utilizing a key which is differently bitted from that of the lock of FIG. 15.
Figure 15:
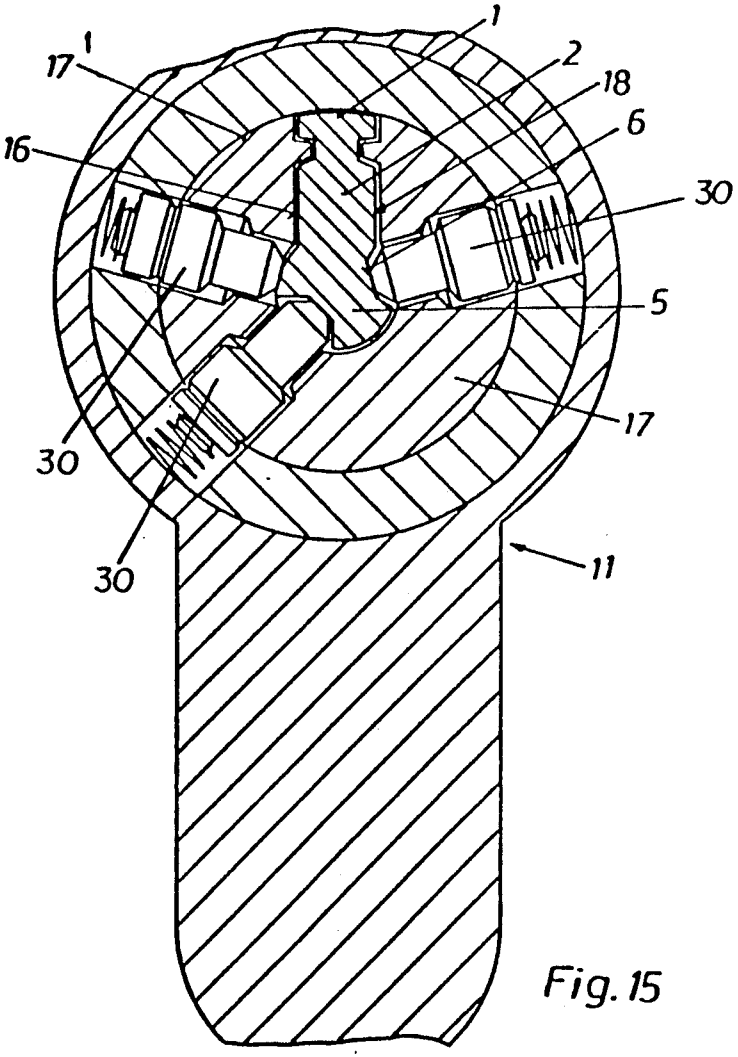
FIG. 15 is a cross sectional view of a cylinder lock having a key formed from the blank of FIG. 1 inserted therein.

FIGS. 15 and 16 show cylinder locks which also have key channels 16 which open upwardly at the periphery 17' of the core 17 so that the back 1 of the key 18 which is inserted into the lock can lie substantially flush with the cylindrical periphery 17". In these embodiments, moreover, the tumbler pins 30 can have various orientations depending upon the bitting of the bitting portion 5. Each tumbler pin 30 will, of course, comprise two pins in tandem biased by a spring as described for the tumbler pin pairs of FIG. 14. A comparison of FIGS. 15 and 16 will show that the locks can be identical except for the angular orientations of the tumbler pins and the keys can be identical except for the different angular orientations of the recesses 6 formed in the respective keys.

Each tumbler pin in the embodiments of FIGS. 15 and 16 may represent a row of such tumbler pins with various spacings apart along the row corresponding to various spacings of the recesses 6. Master keys can be provided for these systems which are common to both locks as long as they have corresponding recesses.

It will be apparent that in the thick bitting regions 5 of the key, other types of recesses than the frustoconical drilled or milled recesses shown can be formed. These recesses can, additionally, be pressed into the keys or can be milled in different configurations.

The illustrated recesses have advantages over conventional bitted keys and even prior art keys with recesses in that there are no sharp-edged portions or circular cylindrical edges which allow contaminants to accumulate and can block operation of the key.

Figure 17:
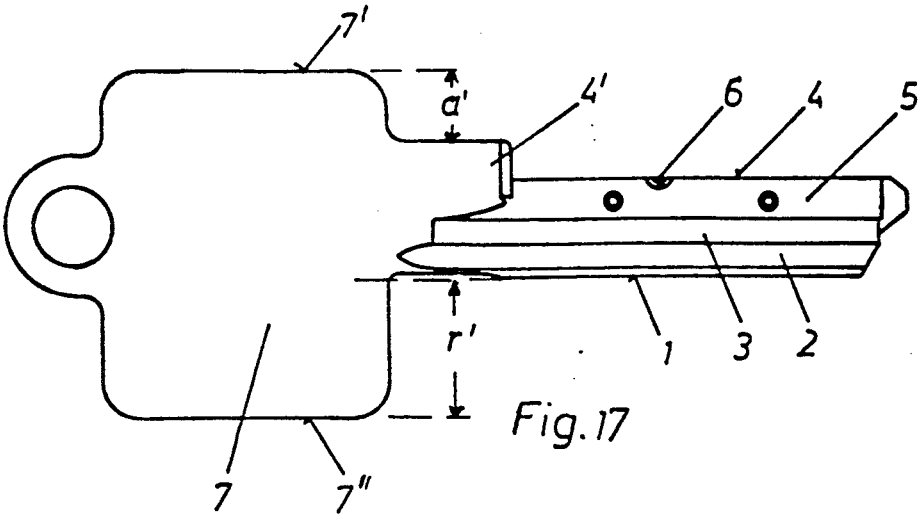
FIG. 17 is a cylinder key of a different configuration from those previously described and in which the greater cross section bar portion of the blade is located in a position which is reversed from that of the key of FIG. 3.

The key of FIG. 17 differs from those which have been described heretofore in that the abutment 4' is provided at the top of the key and, as in the other embodiments, the bar portion 5 extends from the abutment 4', here at the top of the key. The back of the key lies at 1 on the underside. In other words, in this embodiment, the spacing r' of the key back 1 from the edge 7" of the handle 7 is greater than the distance a' of the abutment 4' from the corresponding outer edge 7'. In this embodiment as well, the bitting region 5 projects beyond the blanks of the profile region 2 and is formed with the recesses 6 while the profile region 2 has longitudinal grooves 3 milled into them.

Figure 18:
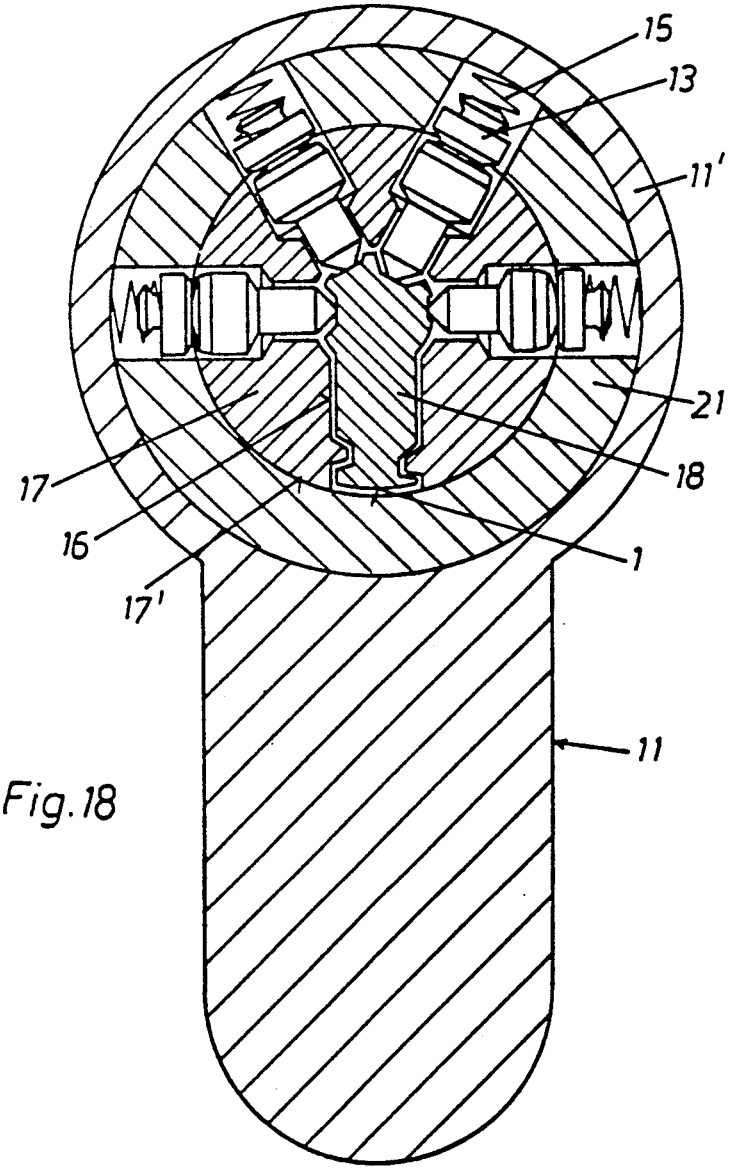
FIG. 18 is a cross sectional view through a lock cylinder in which the key of FIG. 17 has been inserted.

This key can be accommodated in the lock illustrated in FIG. 18 and in this embodiment the key channel 16 opens downwardly at the periphery 17' of the cylinder core 17.

The key 18 is thus inserted with its back 1 downwardly. The advantage of this construction is that it permits a simpler connection of the lock cylinder housing 11' with the cylinder body 21 formed as a nonrotatable tube and which accommodates the springs 15 and the tumbler pins 13. A downward orientation of the key back 1 and the key channel 16 has been found to be advantageous also in that the lock cylinder is less sensitive to the accumulation of dirt and contaminants.

We claim:

1. A key for a cylinder lock having a cylinder core rotatable in a cylinder body, said cylinder body being formed with tumbler pins engageable with the key and said core having a cylindrical periphery and a key-receiving channel open at said periphery, said key comprising:

a handle;

an abutment formed on said handle; and an elongated blade extending from said abutment, said blade being formed with:

a back conforming substantially to said periphery, a profile region formed with said back and having opposite flanks adapted to be formed with longitudinal grooves establishing a profiling of said profile region and controlling insertion of said blade in said core, and a bitting region having a bar configuration adjacent said profile region and extending longitudinally over the full length of the blade, said bitting region accommodating a plurality of rows of recesses engageable by said tumbler pins, said bitting region being wider than said profile region and being rounded generally cylindrically, said bitting region extending to said abutment, said profile region of said blade in a radial direction having a height (H) greater than a height (h) of said bitting region, said profile region having generally parallel flanks and said bitting region extending outwardly on opposite sides of said blade beyond said flanks, said bitting region having a circularly cylindrical configuration with longitudinally extending flats along said opposite sides and an underside of said blade.

2. The key defined in claim 1 wherein said bitting region is formed with recesses engageable by tumbler pins and angularly and axially spaced along said bitting region.

3. The key defined in claim 2 wherein recesses formed in said bitting region merge into one another.

4. The key defined in claim 3 wherein recesses formed in said bitting region lie at substantially the same axial location along said blade.

5. The key defined in claim 1 wherein said bitting region projects at an end of said blade opposite said handle beyond said profile region and is formed with a frustoconical projection.

6. The key defined in claim 1 wherein said blade is offset from a center on said handle and a distance of said back from a corresponding edge of said handle is shorter than a distance from said abutment to a corresponding edge of said handle.

7. The key defined in claim 1 wherein said blade is offset from a center on said handle and a distance of said back from a corresponding edge of said handle is greater than a distance from said abutment to a corresponding edge of said handle.

8. A key for a cylinder lock having a cylinder core rotatable in a cylinder body, said cylinder body being formed with tumbler pins engageable with the key and said core having a cylindrical periphery and a key-receiving channel open at said periphery, said key comprising:

a handle;

an abutment formed on said handle; and an elongated blade extending from said abutment, said blade being formed with:

a back conforming substantially to said periphery, a profile region formed with said back and having opposite flanks adapted to be formed with longitudinal grooves establishing a profiling of said profile region and controlling insertion of said blade in said core, and a bitting region having a bar configuration adjacent said profile region and extending longitudinally over the full length of the blade, said bitting region accommodating a plurality of rows of recesses engageable by said tumbler pins, said bitting region being wider than said profile region and being rounded generally cylindrically, said bitting region extending to said abutment, said profile region of said blade in a radial direction having a height (H) greater than a height (h) of said bitting region, said profile region having generally parallel flanks and said bitting region extending outwardly on opposite sides of said blade beyond said flanks, said profile region being formed with at least one transverse throughgoing bore, said key further comprising a respective test pin limitedly shiftable in said bore, beveled at opposite ends and of a length greater than a thickness of said profile region.

9. The key defined in claim 8 wherein said bitting region has a circularly cylindrical configuration.

10. The key defined in claim 8 wherein said bitting region has a circularly cylindrical configuration with longitudinally extending flats along said opposite sides and an underside of said blade.

11. The key defined in claim 8 wherein said bitting region is formed with recesses engageable by tumbler pins and angularly and axially spaced along said bitting region.

12. The key defined in claim 11 wherein recesses formed in said bitting region merge into one another.

13. The key defined in claim 11 wherein recesses formed in said bitting region lie at substantially the same axial location along said blade.

14. The key defined in claim 8 wherein said bitting region projects at an end of said blade opposite said handle beyond said profile region and is formed with a frustoconical projection.

15. The key defined in claim 8 wherein said blade is offset from a center on said handle and a distance of said back from a corresponding edge of said handle is shorter than a distance from said abutment to a corresponding edge of said handle.

16. The key defined in claim 8 wherein said blade is offset from a center of said handle and a distance of said back from a corresponding edge of said handle is greater than a distance from said abutment to a corresponding edge of said handle.

* * * * *